US006299183B1

(12) United States Patent
Kaneko

(10) Patent No.: US 6,299,183 B1
(45) Date of Patent: Oct. 9, 2001

(54) GOLF BAG

(75) Inventor: Nariie Kaneko, Osaka (JP)

(73) Assignee: Two and One Co., Ltd., Osaka (JP)

( * ) Notice: Subject to any disclaimer, the term of this patent is extended or adjusted under 35 U.S.C. 154(b) by 0 days.

(21) Appl. No.: 09/481,497

(22) Filed: Jan. 12, 2000

(30) Foreign Application Priority Data

Aug. 20, 1999 (JP) ..... 11-234113
Dec. 7, 1999 (JP) ..... 11-347716

(51) Int. Cl.[7] ..... B62B 1/00

(52) U.S. Cl. ..... 280/47.26; 280/47.315; 280/47.24

(58) Field of Search ..... 280/47.26, 47.315, 280/47.28, 47.17, 47.18, 47.24, 47.27, DIG. 5, DIG. 6; 206/278

(56) References Cited

U.S. PATENT DOCUMENTS 4,026,570 * 5/1977 Feinberg ..... 280/47.17
4,753,446 * 6/1988 Mills ..... 280/47.18
5,383,505 * 1/1995 Cordasco, Jr. ..... 150/159
5,515,897 * 5/1996 Fehan ..... 150/159
5,924,709 * 7/1999 Yang ..... 280/47.26

* cited by examiner

*Primary Examiner*—Brian L. Johnson
*Assistant Examiner*—Tony Winner
(74) *Attorney, Agent, or Firm*—Wenderoth, Lind & Ponack L.L.P.

(57) ABSTRACT

A golf bag which can be moved easily by a player or a caddie. Wheels are mounted to the bottom of the body of the golf bag such that when the bag is stood erect on a flat surface, the golf bag is supported on the bottom of the body alone with the wheels not in contact with the flat surface, or on both the bottom and the wheels, and that when the body is inclined in a predetermined direction by a predetermined angle, the bag is supported on the wheels alone. In this state, the bag can be moved by rolling. A retractable handle may be attached to the body for easy carrying.

5 Claims, 7 Drawing Sheets

GOLF BAG

BACKGROUND OF THE INVENTION

The invention relates to a golf bag.

If one full golf club set including woods, irons and a putter, plus practice clubs are put in one golf bag, the bag will weigh as heavy as about 10 kg.

A golf bag has a shoulder strap and is usually carried by a caddie or player on his shoulder.

Carrying such a heavy bag on a shoulder from one hole to another is a lot of labor and troublesome.

An object of this invention is to provide a golf bag which can be carried easily even if it contains many clubs and thus is heavy.

SUMMARY OF THE INVENTION

According to the invention, there is provided a golf bag comprising a body having a bottom, and wheels mounted to the bottom of the body, the wheels being mounted such that when the body is stood erect on a flat surface, it is supported on the bottom alone with the wheels not in contact with the flat surface, or on both the bottom and the wheels, and such that when the body is tilted in a proper direction, the body is supported on the wheels alone.

With this arrangement, by tilting the golf bag so that only the wheels get into contact with ground, the golf bag can be easily moved on the wheels.

The wheels should be detachably mounted on the body. With this arrangement, when the wheels get worn, they can be replaced with new ones. Thus the golf bag can be used semi-permanently unless any other damage occurs.

In order for the user to easily identify club numbers in a golf bag and take out a proper club by gripping its neck, the necks of all the clubs in the bag, including short clubs, i.e. short irons and putter, have to protrude from the top of the bag. For this purpose, most golf bags are up to one meter tall.

In order to tow such a short bag by gripping the highest point of the bag, the user has to walk awkwardly with his back hunched like a monkey. The extension handle allows the user to walk like a human with his back straight while towing the bag.

Other features and objects of the present invention will become apparent from the following description made with reference to the accompanying drawings, in which:

DETAILED DESCRIPTION OF THE PREFERRED EMBODIMENT

Figure 1:
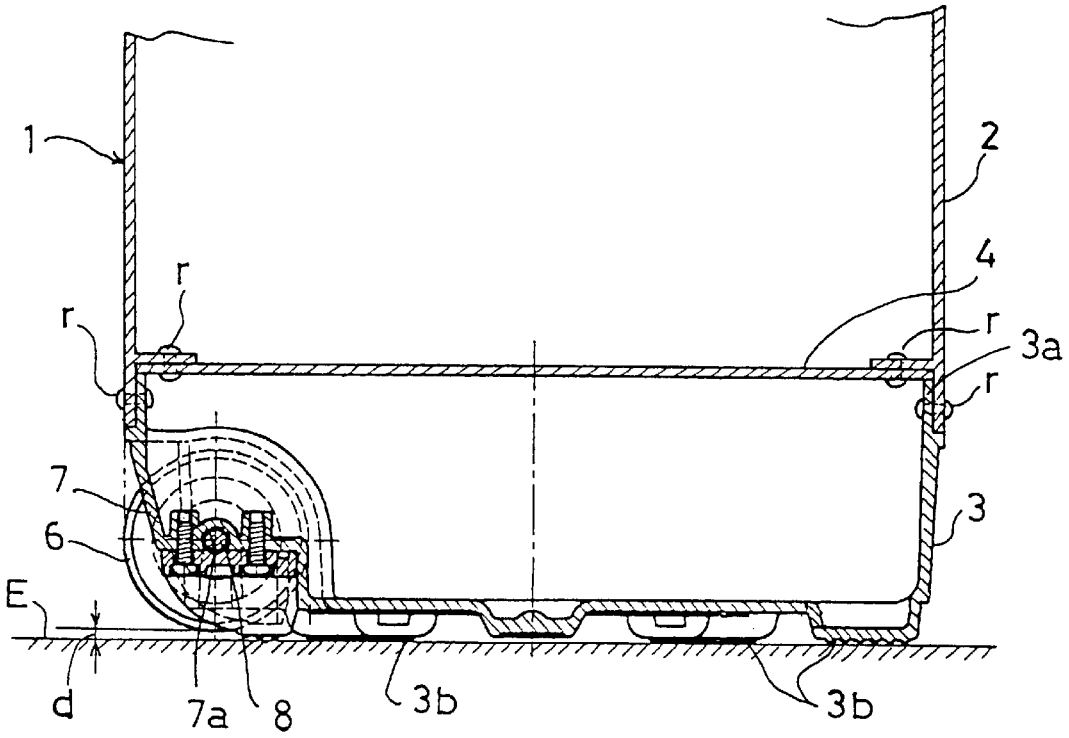
FIG. 1 is a partial sectional view of a golf bag embodying the invention.
Figure 2A:
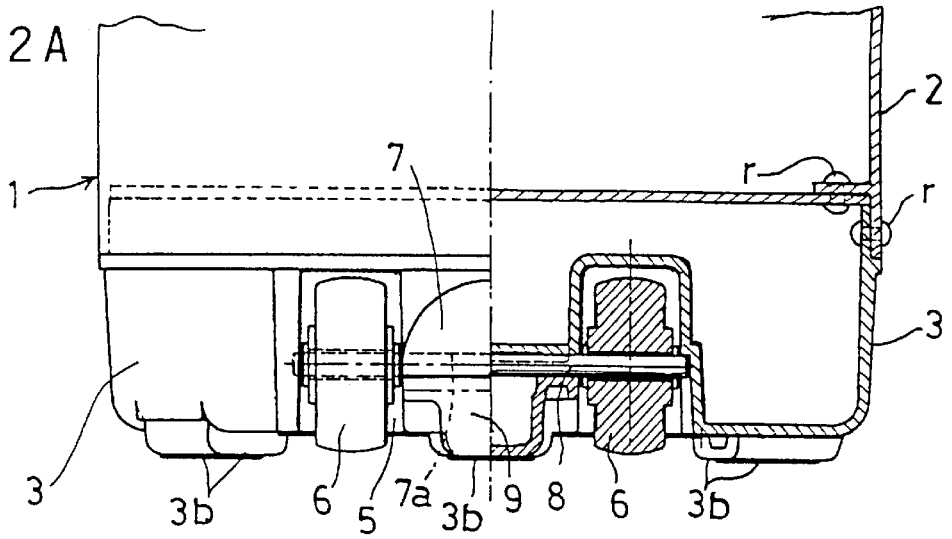
FIG. 2A is a partially cutaway side view of the golf bag of FIG. 1.
Figure 2B:
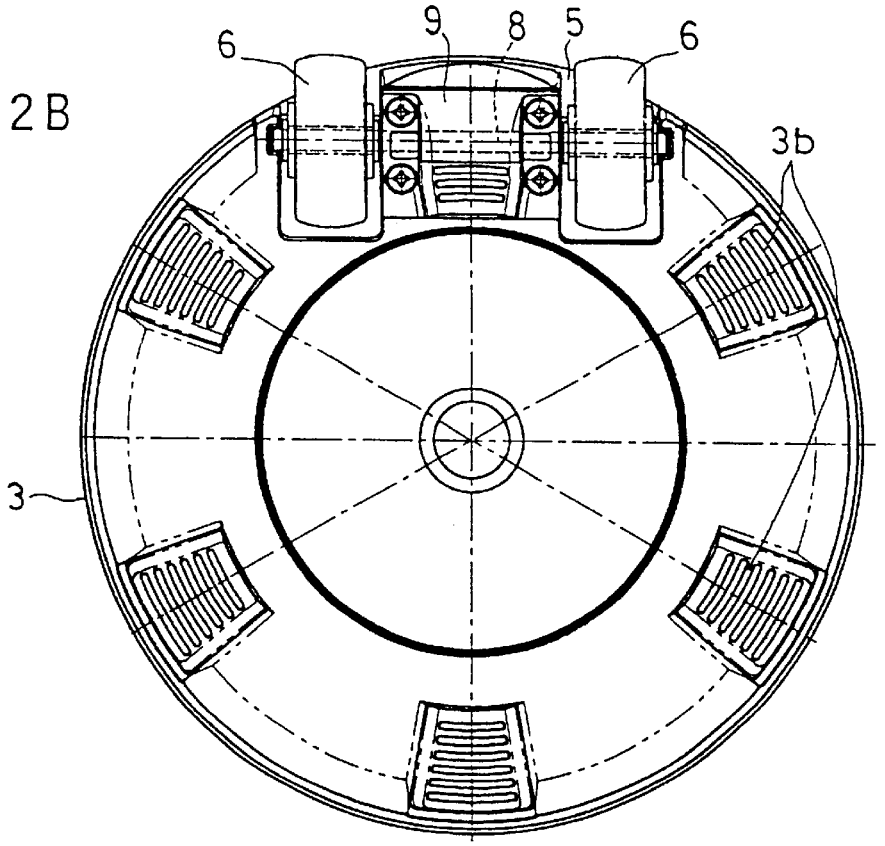
FIG. 2B is its bottom view.

First referring to FIGS. 1 and 2, the golf bag 1 according to the invention includes a cylindrical body 2, a disk member 4 secured to the bottom edge of the cylindrical body 2 by rivets r, and a cup-shaped member 3 mounted to the bottom of the cylindrical body 2 by inserting its top edge 3*a* into the bottom edge of the body 2 and joining them together by means of rivets r. The disk member 4 serves as a bottom of the golf bag 1. The members 3 and 4 are made of a hard resin.

Figure 3:
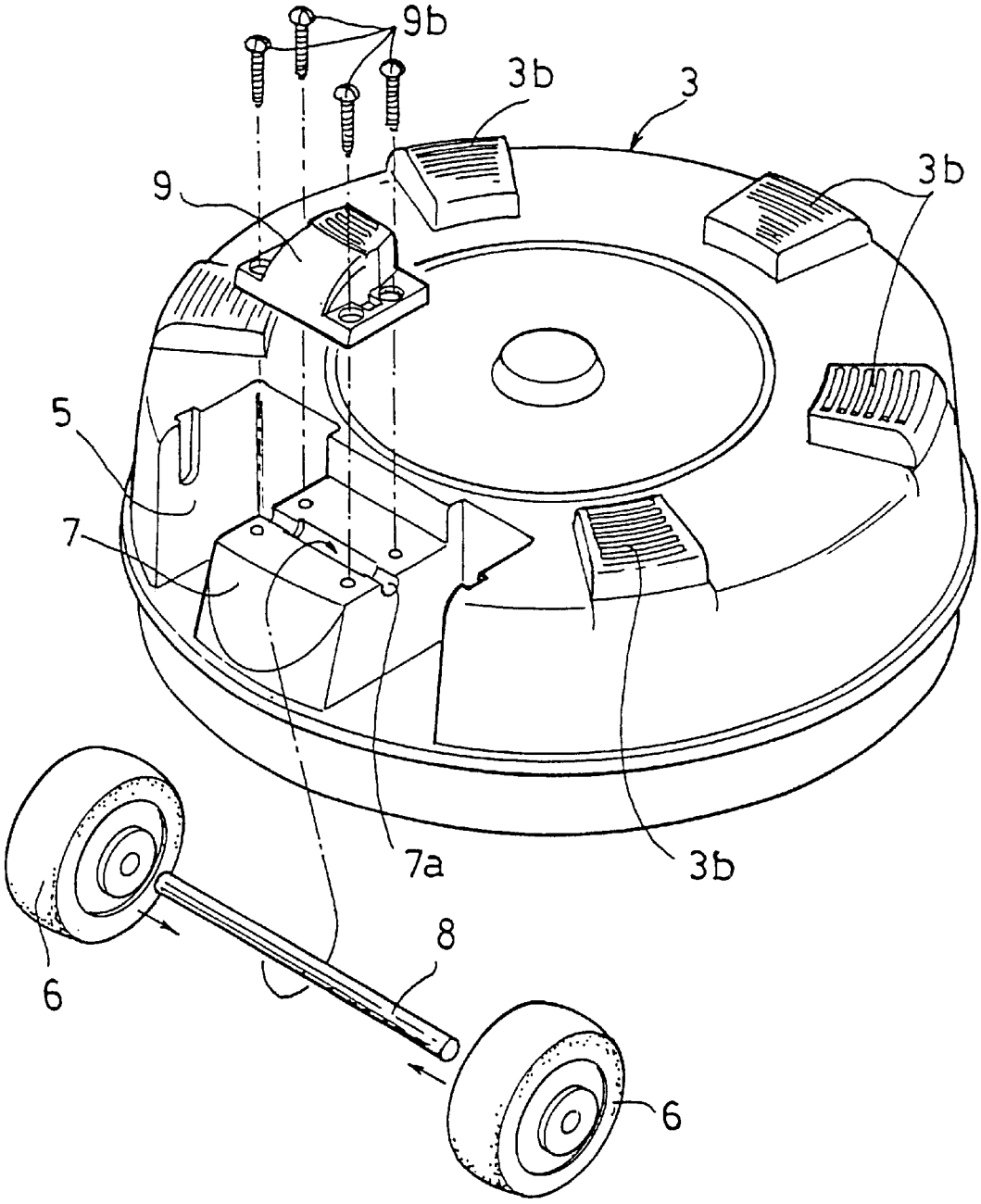
FIG. 3 is a bottom perspective view of a bottom member of the golf bag of FIG. 1.

Referring to FIGS. 1 through 3, the cup member 3 has a bottom in which is formed a recess 5 in which are mounted wheels 6. FIG. 3 shows the bottom of the cup member 3. As shown, the wheels 6 are carried on an axle 8 detachably fitted in a semicylindrical groove 7*a* formed in a protrusion 7 formed on the bottom surface of the recess 5. With the axle 8 fitted in the groove 7*a*, an axle support cover 9 is detachably fastened to the protrusion 7 by screws 9*b*.

Figure 4A:
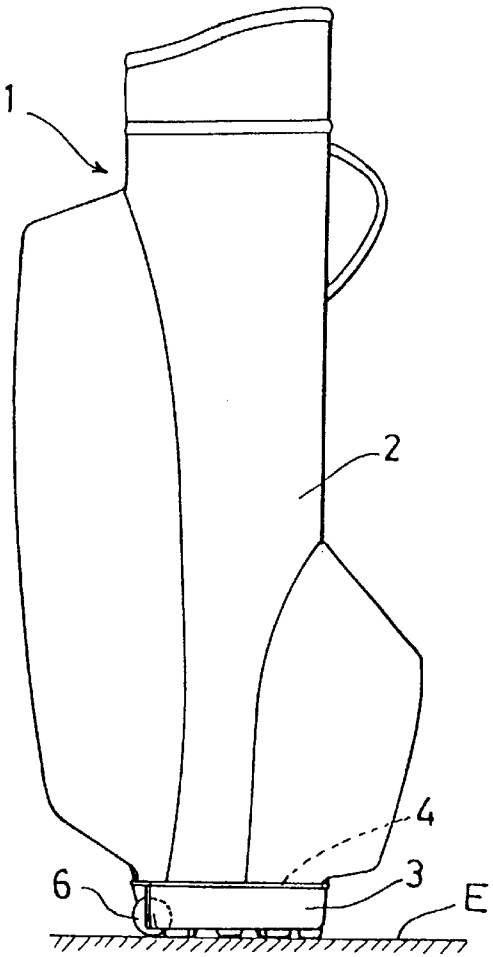
FIG. 4A is a schematic side view of the golf bag of FIG. 1 when stood erect.

When the bag 1 is erected on flat ground E as shown in FIG. 4A, a slight gap d forms between the wheels 6 and the ground E. On the bottom of the cup member 3, a plurality of protrusions 3*b* having flat surfaces are formed. With the bag standing erect on the flat surface E, the flat surfaces of the protrusions 3*b* contact the ground surface E, so that the bag stands on the protrusions in this state. Thus, even on a slope, the bag will not roll down on the wheels 6.

Figure 4B:
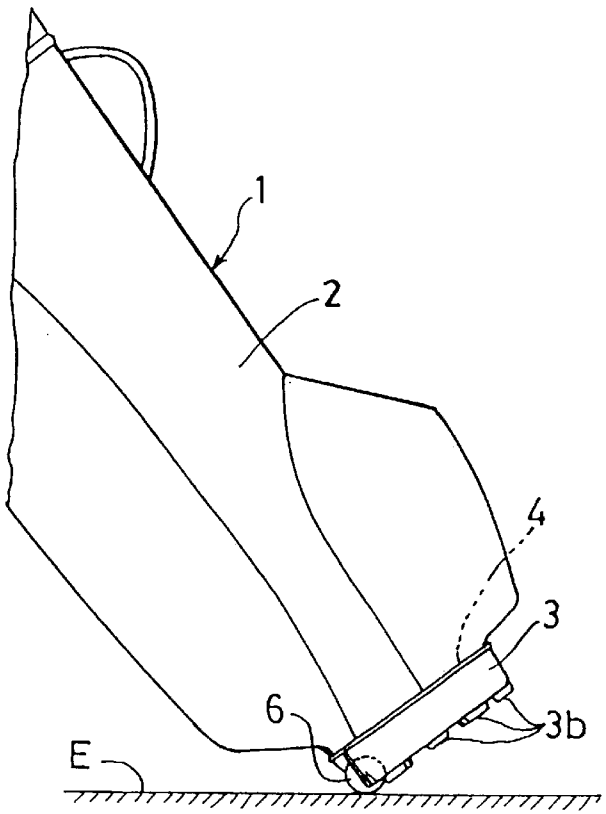
FIG. 4B shows the state when the bag is inclined until it is supported on the wheels alone, ready to be moved by rolling.

To move the bag, it is inclined until it stands on the wheels 6 alone as shown in FIG. 4B, and pulled or pushed to move it. Thus, the golf bag 1 of the invention can be rolled to a desired place without the need to carry it on the shoulder.

Since the wheels 6 are detachable from the body 2, when the wheels 6 are worn or otherwise damaged, they can be replaced. Thus it is possible to keep using the bag simply by replacing the wheels 6.

In the embodiment, in order that the bag will not roll down on the wheels 6 when placed on a slope, the wheels are mounted so as not to touch the ground when the bag is stood erect. But in order that the bag can be more easily inclined to the position shown in FIG. 4B, the wheels 6 may be mounted so as to touch the ground when the bag is stood erect.

In the case of such an arrangement, the wheels 6 may be equipped with brakes. Such brakes are applied when the bag is stood erect, and released to roll the bag.

Figure 5:
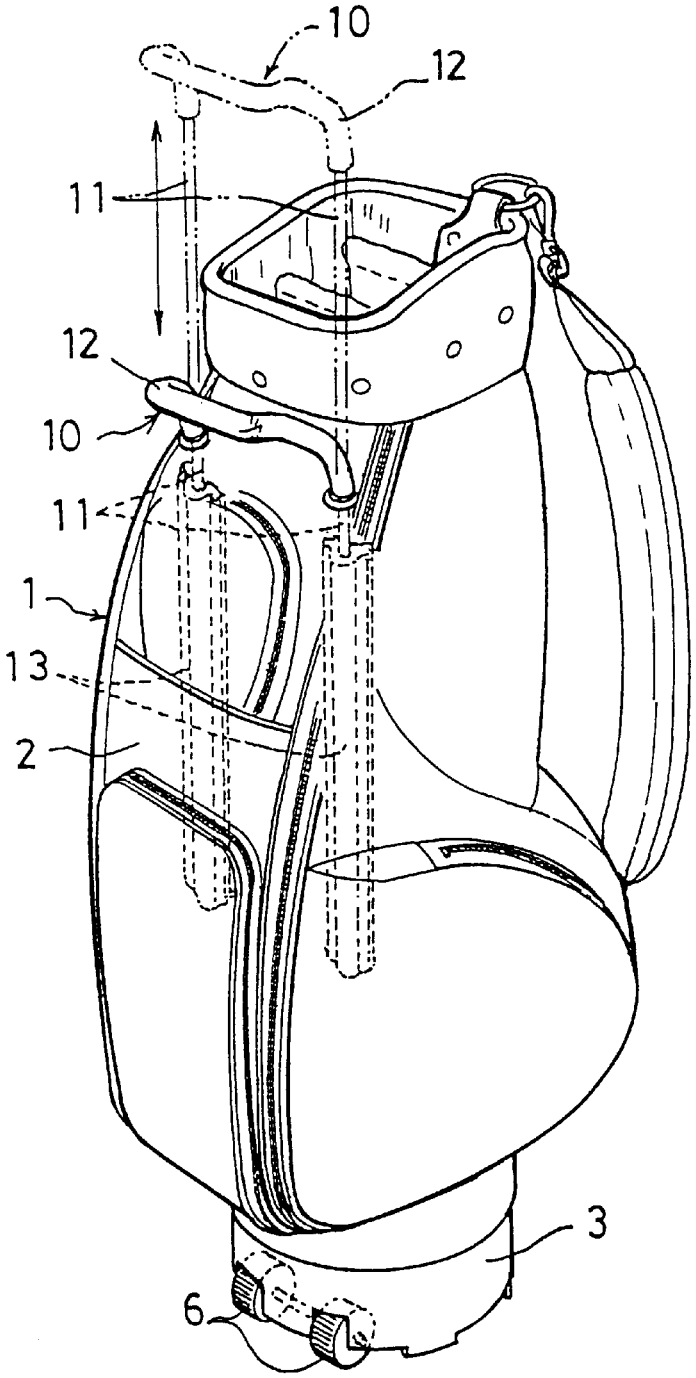
FIG. 5 is a perspective view of another embodiment.
Figure 6A:
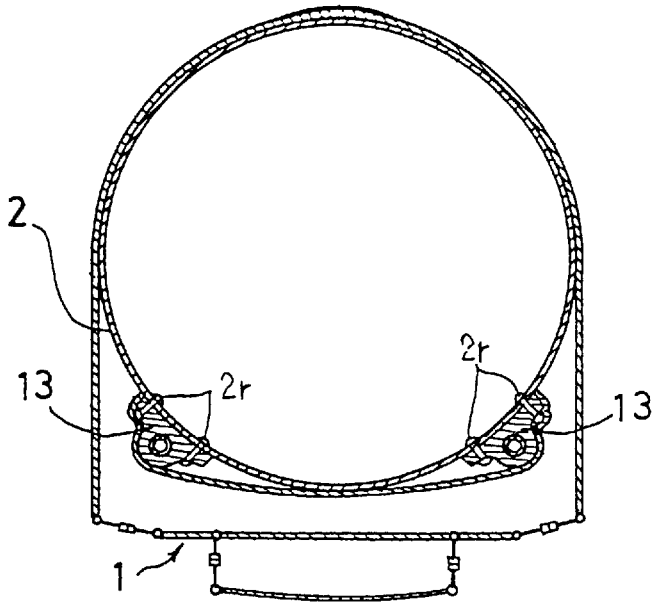
FIG. 6A is a sectional view of the same.
Figure 6C:
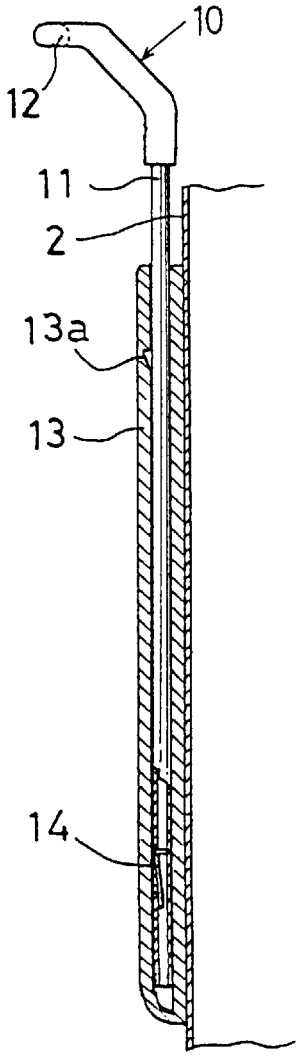
FIG. 6C is an enlarged view of a portion of FIG. 6B.
Figure 6B:
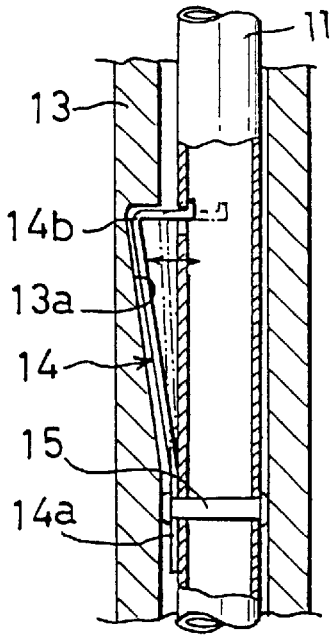
FIG. 6B shows the handle in a retracted state.
Figure 7:
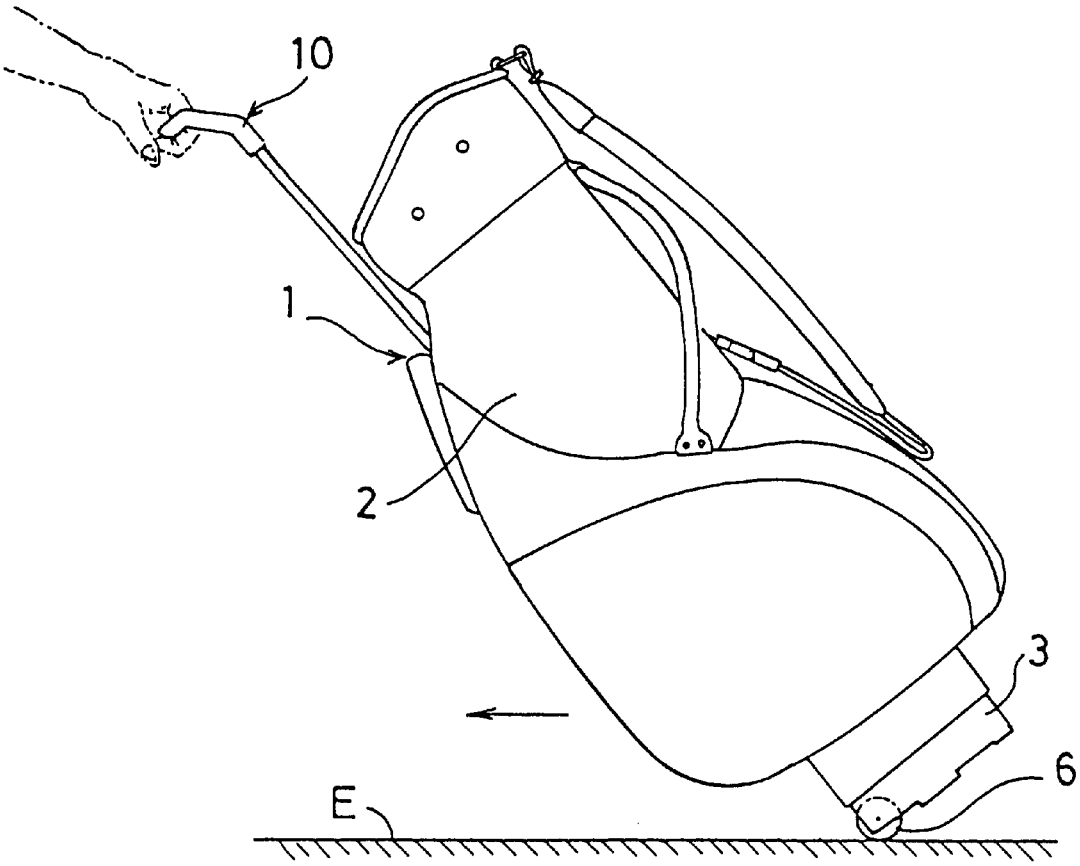
FIG. 7 is a view showing how the embodiment of FIG. 5 is pulled.

FIGS. 5–7 show a golf bag having an extension handle 10 for easy carrying.

The handle 10 comprises a pair of vertical pipes (serving as elongated handle members) 11 slidably mounted into vertical tubes 13 fixed to the inner wall of the bag by rivets 2*r* (FIGS. 5 and 6A), and a crossbar 12 or grip by which the vertical pipes 11 are connected together at its tip ends. The vertical tubes 13 have an inner diameter slightly larger than the outer diameter of the pipes 11 so that the pipes can smoothly slide in the tubes without shaking.

A stopper means is provided for preventing each pipe 11 from coming out of the tube 13.

As shown in FIGS. 6B and 6C, the stopper means comprises a leaf spring 14 including a horizontal top portion 14*b* having its tip inserted into the pipe 11, and fixed at its bottom end 14*a* to a portion of the pipe 11 near its bottom end by a rivet 15, and a recess 13*a* formed in the tube 13 near its top end. The recess 13*a* is defined by a top horizontal ledge and a tapered wall. At its rest position, the spring 14 snugly fits in the recess 13*a* as shown in FIG. 6C. When the pipe 11 is retracted in the tube 13 as shown in FIG. 6B, the top horizontal portion 14*b* is biased rightwardly in the figures from the rest position as shown by phantom line in FIG. 6C by the inner wall of the tube 13. When the pipe 11 is raised and the top horizontal portion 14*b* of the spring 14 enters the recess 13*a*, it resiliently moves leftwardly until it engages the top ledge of the recess 13*a*. Once the top horizontal portion 14*b* engages the top ledge of the recess 13*a*, the pipe 11 cannot be raised any further. Now the golf bag 2 can be pulled by the grip 12.

To move the bag, the handle 10 is pulled out to the limit and the bag is pulled by gripping the thus extended handle 10 as shown in FIG. 7. Since the handle is located at a high position even when the bag is inclined, one can pull the bag with his back straight. When the bag 1 is at rest, the handle is moved to its fully retracted position shown in FIG. 6B simply by pushing it down.

What is claimed is:

1. A golf bag comprising:

a body having a bottom;

a cup member mounted to the bottom of said body and having a bottom formed with a recess;

a protrusion protruding from the bottom of said cup member and disposed in said recess, said protrusion having a groove formed therein;

an axle detachably fitted in said groove;

a pair of wheels carried on said axle; and an axle support cover detachably fastened to said protrusion to secure said axle in said groove;

wherein said wheels are mounted so that when said body is tilted, said body is supported on said wheels alone.

2. The golf bag as claimed in claim 1, further comprising a retractable handle mounted to said body, said retractable handle comprising a pair of vertical tubes fixed to said body, a pair of elongated handle members slidably mounted in said vertical tubes, a crossbar connecting said elongated handle members together at top ends thereof, and a stopper for preventing said elongated handle members from coming out of said vertical tubes.

3. The golf bag as claimed in claim 1, wherein said recess opens downwardly; and said protrusion protrudes downwardly from the bottom of said cup member.

4. The golf bag as claimed in claim 1, wherein said recess opens downwardly and sidewardly; and said protrusion protrudes downwardly from the bottom of said cup member.

5. The golf bag as claimed in claim 1, wherein said axles support cover is detachably fastened to said protrusion by screws.

* * * * *